United States Patent [19]

Kratt

[11] Patent Number: 4,506,373

[45] Date of Patent: Mar. 19, 1985

[54] RESETTABLE MECHANICAL COUNTER

[75] Inventor: Kurt Kratt, Aldingen, Fed. Rep. of Germany

[73] Assignee: J. Hengstler K.G., Aldingen, Fed. Rep. of Germany

[21] Appl. No.: 460,398

[22] Filed: Jan. 24, 1983

[30] Foreign Application Priority Data

Jan. 30, 1982 [DE] Fed. Rep. of Germany ..... 3203137

[51] Int. Cl.[3] ..... G06M 1/28

[52] U.S. Cl. ..... 377/88; 377/86

[58] Field of Search ..... 377/82, 88, 86

[56] References Cited

U.S. PATENT DOCUMENTS 3,588,476 6/1971 LaPointe ..... 377/88

3,648,028 3/1972 Hara et al. ..... 377/88

4,264,806 4/1981 Kubler ..... 377/88

*Primary Examiner*—John S. Heyman

*Attorney, Agent, or Firm*—Balogh, Osann, Kramer, Dvorak, Genova & Traub

[57] ABSTRACT

This invention relates to a resettable mechanical counter. It is an object of the invention to provide such a counter in which the means required to reset the counter constitute a key which can be removed from the counter and can be used to reset a plurality of counters so that the counters are simplified and can be manufactured at lower cost. This object is accomplished by the provision of a resetting slider, which is provided with disengaging cams and adapted to be inserted into tracks provided on the frame of the counter and to be removed from said frame.

12 Claims, 4 Drawing Figures

RESETTABLE MECHANICAL COUNTER

Figure 1:
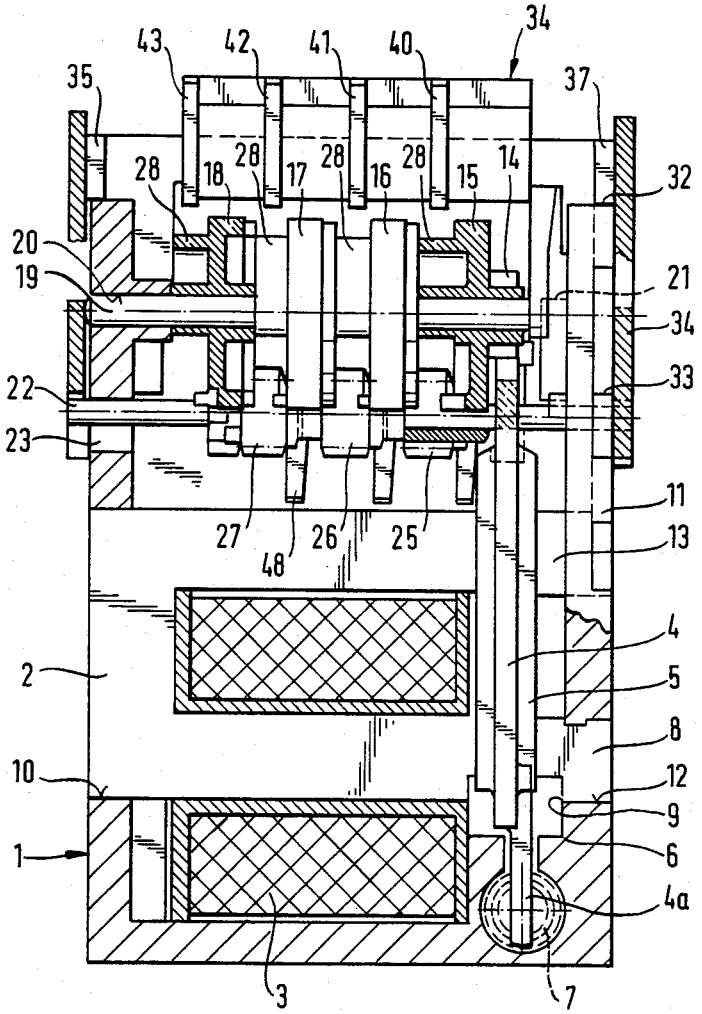

This invention relates to a resettable mechanical counter.

Various types of resettable mechanical counters are known, in which the resetting means comprises additional parts, which must be separately installed and must be protected against arbitrary actuation and in many cases must be lockable to ensure that only persons authorized to reset the counter can reset it after reading its count.

It is an object of the invention to provide a resettable mechanical counter in which the means required to reset the counter consist of keylike elements which can be removed from the counter so that they can be used to reset a number of counters. The counters of such a system are simpler and can be manufactured at lower cost.

To accomplish that object the resettable mechanical counter according to the invention comprises a resetting slider, which is adapted to be inserted into and removed from tracks provided on the frame of the counter, and which comprises disengaging cams, which are so arranged that upon a displacement of the slider the cams engage the pinion axle to move carry pinions carried by the pinion axle out of mesh before resetting fingers engage heart-shaped cams of the digit wheels and reset the latter and hold them in the reset position until the spring-loaded pinion axle is released by the lifting cams of the resetting slider, whereafter the carry pinions move into mesh with the digit wheels, which have been reset to their zero position. The resetting slider is U-shaped and embraces the side walls of the frme with respective legs, which have guiding means, which permit the slider to be engaged with the frame in an initial position of the slider, whereas the tracks guide the slider during its resetting movement to a position short of a limit stop, and the resetting slider can be laterally removed from the frame when the resetting slider engages the limit stop. That slider constitutes a self-contained resetting device, which serves also as a key and can be used for resetting each of a plurality of counting mechanisms.

The invention may be used to reset adding counters to zero and to reset subtracting counters to a preset count.

A preferred embodiment of a mechanical counter provided with a resetting device according to the invention is shown on the drawing in a condition in which the resetting slider is being inserted. In the drawings, FIG. 1 is a top plan view showing a mechanical counter, partly cut open, provided with a resetting slider, FIG. 2 is a side elevation showing the mechanical counter without a resetting slider, FIG. 3 is a vertical longitudinal sectional view showing the resetting slider and FIG. 4 consists of three sectional views showing the resetting slider.

Figure 2:
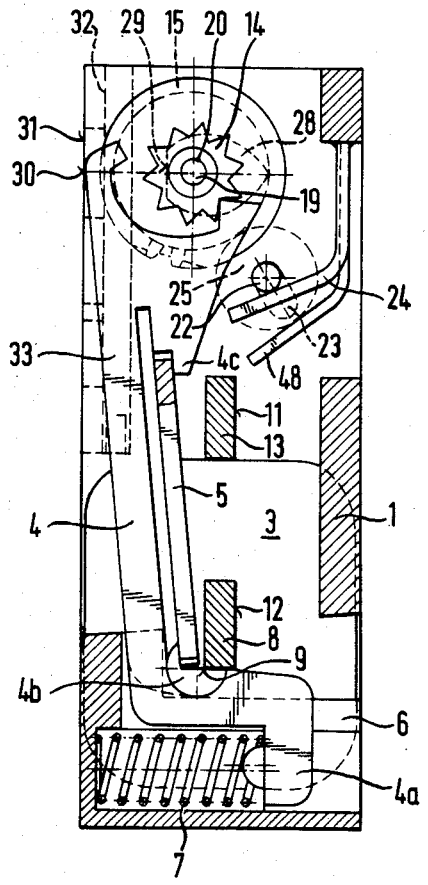
Figure 3:
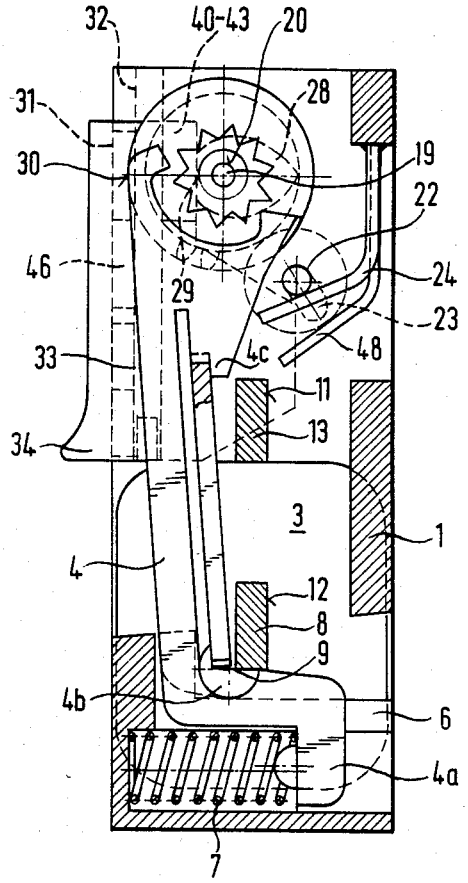

The mechanical counter shown in FIGS. 1 to 3 comprises a frame 1 and a magnetizable yoke 2 which carries a solenoid coil 3 and is contained in the frame 1. The coil 3, the stepping rocker 4 and the armature 5 connected to the rocker 4 constitute the means for driving the counter. The stepping rocker 4 is movably mounted in a recess 6, which is formed in the frame 1 and is open on one side and serves to guide the stepping rocker 4 in radial and axial directions. The frame 1 is formed with a chamber, which communicates with the recess 4 and contains a spring 7, which bears on the armature 5 and tends to urge pivot pins 4*b* of the rocker 4 against the edge 9 of the leg 8 of the yoke 2. The armature 5 is loosely received at one end in a recess of the pin 4*b* and is embraced at the other end by the rocker 4 at 4*c*.

The magnetizable yoke 2 is a flat U-shaped stamping and is held in apertures 10, 11 and 12 of the frame 1. The leg 8 of the yoke carries the solenoid coil 3. The air gap of the magnetic circuit is defined by the second leg 13 of the yoke 8 and the armature 5, which has been disengaged from the leg 13 by the rocker 4 under the action of the spring 7 acting on the lever arm 4*a* of the rocker 4. In response to an electric pulse energizing the solenoid coil 3, the armature 5 is attracted to the leg 13 so that the least significant digit wheel 15 is caused to perform one half-step by means of the rocker 4 and the stepping wheel 14. When the coil 3 has been deenergized, the spring 7 moves the armature 5 away from the leg 13 so that the second half-step is performed.

The digit wheels 15, 16, 17 and 18 are rotatably mounted on an axle 19, which is held at both ends in bores 20, 21 formed in the frame 1. A pinion axle 22 is rotatably mounted in oblique slots 23 provided in the frame 1 on opposite sides and is urged toward the axle 19 by two springs 24, which are integrally molded with the housing 1. In this manner the carry pinions 25, 26, 27 rotatably mounted on the axle 22 are held in mesh with the digit wheels 15 to 18.

Figure 4:
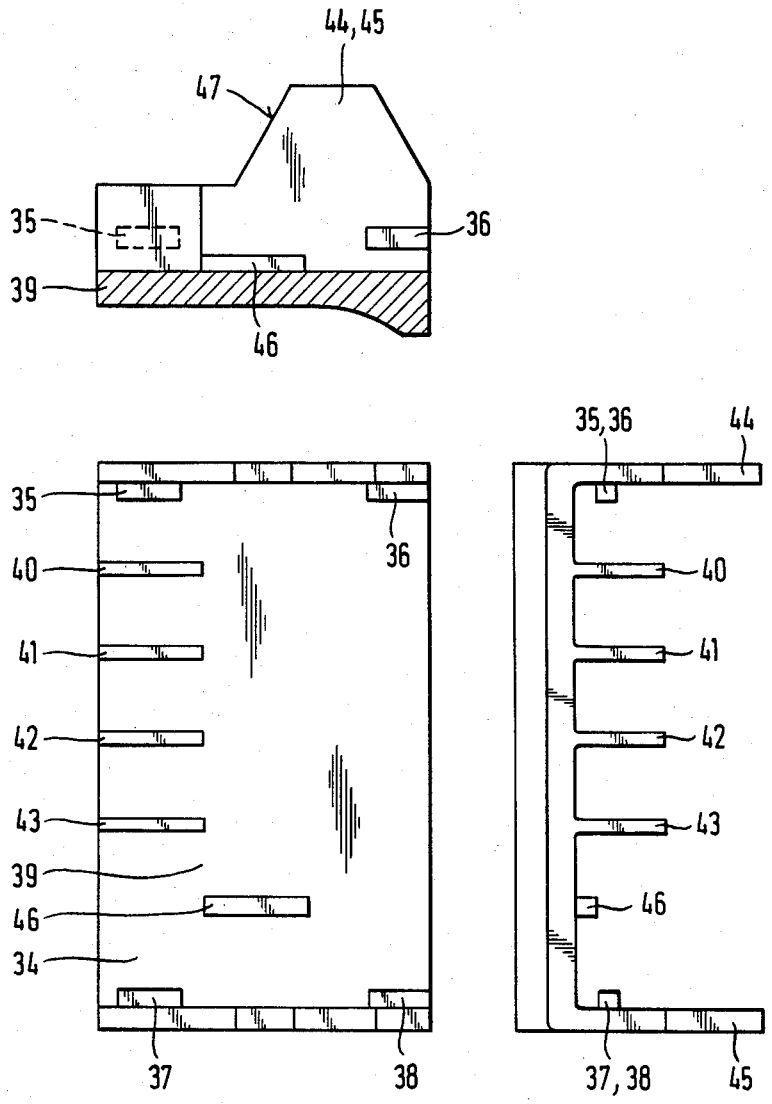

The digit wheels 15 to 18 are resettable by cams 28, which are provided on the respective digit wheels 15 to 18 and have a flat surface, which is parallel to the longitudinal side 31 of the frame 1 when the digit 0 of the associated digit wheel is disposed in the reading area 30. As is also apparent from FIGS. 1 and 2, tracks 32, 33 are formed in each of the two side walls of the frame 1 and serve to receive and guide a resetting slider 34, which is operable to reset the mechanical counter. That resetting slider 34 shown in FIG. 4 is U-shaped and embraces the frame 1 from the broadside 31 and is provided on opposite sides with guiding means 35, 36, 37, 38, which cooperate with the tracks 32, 33 of the frame 1. The slider 34 comprises also a rakelike crosspiece 39, which carries resetting fingers 40, 41, 42, 43, which are associated with respective digit wheels 15 to 18. Further, the slider 34 comprises legs provided with disengaging cams 44, 45 for engaging the pinion shaft 22 at its ends protruding from the frame 1 during the resetting operation. During the resetting operation, an additional cam 46 provided on the crosspiece 39 imparts to the stepping rocker 4 a pivotal movement to a neutral position, in which the rocker 4 is clear of the stepping wheel 14 associated with the least significant digit wheel 15.

With that design of the resetting slider 34 and of the mechanical counter designed to cooperate with that slider, the counter can be reset by the following operation of the slider. The counter is fully operative without the resetting slider 34. When it is desired to reset the counter, the slider 34 is inserted from above into the tracks 32, 33 until the disengaging cams 44, 45 engage the protruding ends of the pinion axle 22. As the slider 34 is pushed along the frame 1 from that initial position, the disengaging cams 44, 45 first move the pinion axle 22 so that the carry pinions 25 to 27 are disengaged from the digit wheels 15 to 18 and thereafter the resetting fingers 40 to 43 acting on the cams 28 rotate the digit wheels 15 to 18 to the zero position. Only when the resetting fingers 40 to 43 are in snug engagement with the flat surface 29 of the cams 28 can the disengaging cams 44, 45 release the pinion axle 22 so that the carry pinions adjusted by the springs 48 are reliably moved into mesh with the still fixed digit wheels 15 to 18.

The oblique slots 23 and the beveled surfaces 47 of the disengaging cams 44, 45 hold the resetting slider 34 against a return movement so that the counter cannot be moved out of its zero position to which it has been reliably moved. When the zero position has been reached, the resetting slider 34 can be laterally removed because the tracks 32, 33 are laterally interrupted in the portion corresponding to that end position of the slider 34.

Because the resetting slider 34 which is provided according to the invention is entirely independent of and separate from those parts of the counter which are required for the counting function and comprises all means required for a reliable resetting operation, a single resetting device serving as a key can be used to reset each of a large number of counters.

What is claimed is:

1. In a resettable mechanical counter comprising a counter frame, a plurality of digit wheels mounted in said frame for mutually independent rotation about a first axis, a plurality of heart-shaped cams, each of which is non-rotatably connected to one of said digit wheels, a pinion axle mounted in said frame and defining a second axis, which is spaced from and parallel to said first axis, a plurality of carry pinions, each of which is adapted to mesh with two adjacent ones of said digit wheels, said carry pinions being mounted on said pinion axle for mutually independent rotation and being movable by said pinion axle into and out of mesh with said digit wheels, spring means for urging said carry pinions toward said digit wheels, and resetting means for moving said carry pinions out of mesh with said digit wheels and for holding said carry pinions out of mesh with said digit wheels and for engaging said heart-shaped cams so as to move said digit wheels to a predetermined position and for subsequently releasing said carry pinions for a movement into mesh with said digit wheels, the improvement residing in that said frame is formed with tracks which are accessible from the outside of said frame, said resetting means comprise a resetting slider, which is engageable with said tracks from the outside of said frame and movable along said tracks to a predetermined end position, said resetting slider carries disengaging cams arranged to engage said pinion axle and to move said carry pinions out of mesh with said digit wheels during an initial part of the movement of said slider along said tracks toward said end position, and to hold said carry pinions out of mesh with said digit wheels during a subsequent part of said movement, and to release said carry pinions for a movement into mesh with said digit wheels after said subsequent part of said movement of said slider has been completed, said resetting slider carries resetting fingers arranged to engage said heart-shaped cams so as to reset said digit wheels to said predetermined position during said subsequent part of said movement of said slider, and to hold said digit wheels in said predetermined position until said disengaging cams have released said carry pinions, and said slider when in said end position is removable from said frame without changing the positions of said digit wheels and said carry pinions.

2. The improvement set forth in claim 1 as applied to a counter in which said resetting means are operable to reset said digit wheels to a zero position, which is said predetermined position.

3. The improvement set forth in claim 1, wherein said frame is open at one end and has two opposite side walls extending from said one end, said tracks are provided on said side walls on the outside thereof and are open at said one end and extend from said one end only along part of the length of said side walls and are terminated by stops remote from said one end, said resetting slider is U-shaped and has two legs, which are provided on the inside with guiding means, which are movable into guided engagement with said tracks from said one end of said frame so that said slider straddles said side walls, said slider is arranged to engage said stop in said end position, said resetting fingers are arranged to enter said frame as said slider is moved along said tracks from said one end of said frame, and said tracks and guiding means permit a removal of said slider from said frame in a direction which is lateral to said tracks when said slider is in said end position.

4. The improvement set forth in claim 1, wherein said tracks are defined in part of their length by guide ribs, which permit a removal of said slider from said frame from said end position in a direction which is lateral to said tracks.

5. The improvement set forth in claim 1, wherein said resetting slider is U-shaped and comprises two legs formed with said disengaging cams, said housing is formed with slots, said pinion axle is mounted in said slots and movable along the same to move said carry pinions into and out of engagement with said digit wheels, and said disengaging cams are arranged to release said pinion axle shortly before said slider has reached said end position.

6. The improvement set forth in claim 5, wherein said resetting slider comprises a rakelike crosspiece connecting said legs and formed on the inside with said resetting fingers.

7. The improvement set forth in claim 6 as applied to a counter in which said digit wheels comprise a least significant digit wheel, a stepping wheel in mesh with said least significant digit wheel, and a rocker which is engageable with said stepping wheel and operable to rotate said least significant digit wheel by means of said stepping wheel in steps, wherein, said slider is provided on the inside with a cam arranged to engage said rocker and to hold said rocker clear of said stepping wheel during the movement of said slider along said tracks to said end position.

8. The improvement set forth in claim 1, wherein said spring means comprise springs which engage opposite end portions of said pinion axle and spring means are provided for engaging said carry pinions when these are disengaged from said digit wheels and for adjusting said carry pinions to a proper position for meshing with said digit wheels.

9. The improvement set forth in claim 1, as applied to a counter in which said digit wheels comprise a least significant digit wheel and a rocker which is operable to rotate said least significant digit wheel in steps, wherein said rocker is provided on opposite sides with pivot pins, and said frame is formed with a recess, which receives said pivot pins and is capable of radially and axially guiding said pivot pins.

10. The improvement set forth in claim 9, wherein said rocker has a first lever arm which is engageable with said least significant digit wheel and disposed on one side of said piviot pins, and a second lever arm on the other side of said pivot pins, an abutment is provided, which is engageable by said pivot pins, and a spring is provided, which biases said second lever arm so as to urge said pivot pins against said abutment.

11. The improvement set forth in claim 9, wherein said counter comprises a solenoid for operating said rocker, said solenoid comprises a magnetizable yoke having a leg, and an armature which is magnetically attractable by said yoke, said armature is loosely inserted into said rocker and is embraced by said rocker remote from said pivot pins so that said rocker is movable with said armature, said leg of said yoke extends transversely to said rocker and armature and is spaced from said rocker, and said armature extends between said rocker and said leg and engages said pivot pins.

12. The improvement set forth in claim 11, wherein said rocker has a first lever arm, which is engageable with said least significant digit wheel and disposed on one side of said pivot pins, and a second lever arm on the other side of said pivot pins, said armature extends between said pivot pins and said leg of said yoke, and a spring is provided, which biases said second lever arm to urge said pivot pins and said armature against said leg of said yoke.

* * * * *